United States Patent [19]

Corvese

[11] Patent Number: 4,706,431

[45] Date of Patent: Nov. 17, 1987

[54] RECESSED DECORATIVE MOULDING FOR WOOD PANEL

[75] Inventor: Vincent Corvese, Thornhill, Canada

[73] Assignee: Oakwood Lymber & Millwork Co. Limited, Downsview, Canada

[21] Appl. No.: 867,806

[22] Filed: May 28, 1986

[51] Int. Cl.[4] ..... E04C 2/38

[52] U.S. Cl. ..... 52/313; 52/312; 52/716

[58] Field of Search ..... 52/312, 313, 316, 716, 52/717; 40/625, 628, 629

[56] References Cited

U.S. PATENT DOCUMENTS 1,988,236 1/1935 Chatfield ..... 52/312

4,327,788 5/1982 Turner ..... 52/316

4,545,162 10/1985 Attaway ..... 52/716

*Primary Examiner*—Henry E. Raduazo

*Attorney, Agent, or Firm*—Sim & McBurney

[57] ABSTRACT

A panel assembly comprises a composite slab having a front surface of a veneer laminated to a core. A moulding is affixed to the slab surface to define a decorative panel design. A groove is provided in the slab to receive the moulding which has a base portion for fitment in the groove and flanges along its edges for overlapping and contacting the veneer along the groove upper edges. The moulding has a recess formed in the base below the flange portions to provide the visual effect of a panel design.

1 Claim, 9 Drawing Figures

FIG.7.
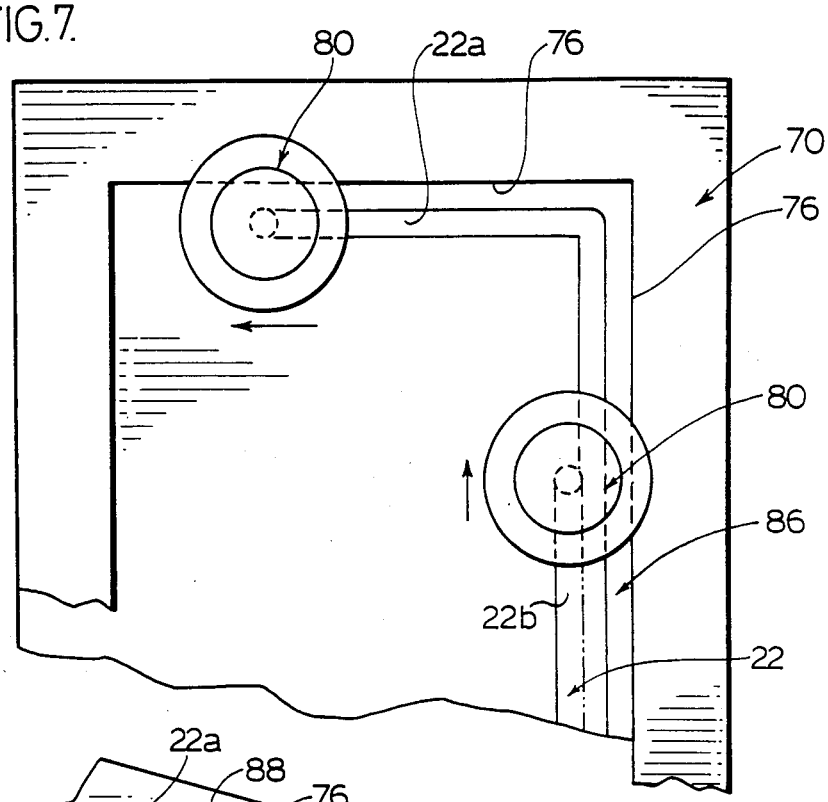
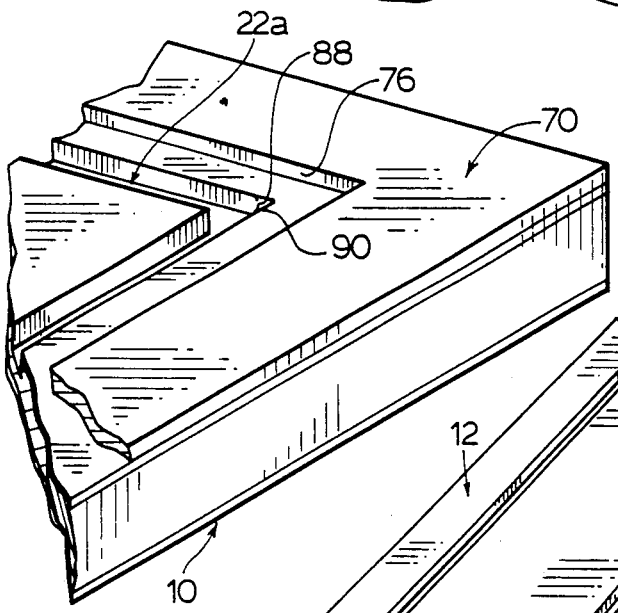
FIG.8.
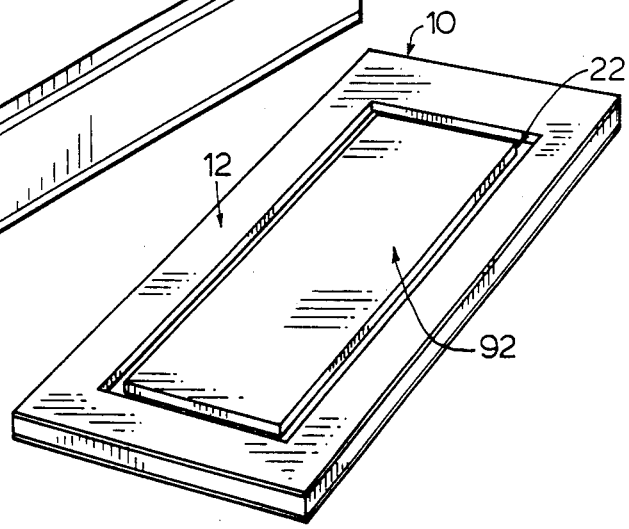
FIG.9.

RECESSED DECORATIVE MOULDING FOR WOOD PANEL

FIELD OF THE INVENTION

This invention relates to fitments of mouldings into a slab of material having a veneer surface to create the effect of panel design in the slab.

BACKGROUND OF THE INVENTION

Decorative mouldings have been applied to surfaces of various types of composite slabs, such as wall panels, doors, cabinet doors, sliding doors and the like. The purpose of the moulding is to enhance the appearance of the slab which may be wood, plastic, metal or the like such that when finished either in its natural finish or painted, a decorative, luxurious panel effect is created. Such panel effect attempts to simulate the overall visual impact created by 19th century wood craftsmen who carved out of solid wood slabs, decorative designs to define individual panels. Such wood carving of today is essentially a lost art and the few artisans left, who are capable of such carvings, could not possibly meet the demand nor provide the panels or doors at marketable price.

It has, therefore, been desirable to simulate the panel effect by using combinations of mouldings with slabs of material, such as in cabinet doors and the like. Panel doors, which have raised surfaces and are foamed in place, are exemplified in U.S. Pat. No. 3,402,520. The outer surfaces of the door may be of metal skins which have been stamped to provide a decorative moulded surface which creates the effect of wood panelling.

In cabinet door constructions, it is very common to provide a moulding on the face of the door to enhance the decorative effect of the door compared to a plain face portion. This is often accomplished by assembling components of the door, particularly of wood, to create the effect of a panel being defined within the face. An example of such door assembly is disclosed in U.S. Pat. No. 3,731,444. Components of the door are assembled and affixed to a door back support. Assembly of such components is time consuming and on a production basis, can result in joints in the components which remain open to detract from the overall appearance.

U.S. Pat. No. 4,083,160 discloses another type of cabinet door construction which involves the use of a veneer either of wood or of synthetic materials such as Formica (trademark). A relief configuration is imparted to the outer face of the door by forming a groove in the door face into which an insert strip is inserted which lies totally within the groove to provide a relief effect. The difficulty with such door construction is that, in forming the groove, the groove edges are chipped by the milling tool. By placing the strip totally within the door, the chipped edges remain which have to be touched up, stained or otherwise modified to remove the blemished appearance to the door front. A similar approach is disclosed in U.S. Pat. No. 1,988,236 where a groove is formed in a door front into which a decorative strip is placed. According to this patent, the solid wood door has the groove formed therein to receive the decorative wooden strip. In view of the door being solid wood, the exposed groove edges can be blended in with the decorative moulding without exposing any dissimilar door core material or chipped veneer portions along the groove edges.

SUMMARY OF THE INVENTION

According to an aspect of this invention, a slab door of standard dimensions comprises a composite having a front surface of veneer laminated to a solid core. A moulding border recessed in the composite slab is provided to define a decorative panel design. A groove is formed in the slab of an outline which defines the moulding border. The groove is generally rectangular in cross-section, as formed in the core and extending through the veneer. The groove has wall portions which define the rectangular shaped groove with the wall portions terminating at the veneer to define upper parallel edges of the groove. The moulding has a base portion for fitment into the groove and a flange portion extending along each side of the base portion for overlapping and covering the veneer along the grooved upper edges. The moulding has a recess formed into the base below the flange portions and below a plane defined by the veneer. The moulding base has an essentially planer lower surface with first and second upright sides merging into respective flange portions. The upright sides slope inwardly from the respective flange and converge towards the base lower surface. The moulding has an inner flange and an outer flange, the first upright side of the moulding base adjacent the outer flange slopes inwardly more than the second upright side adjacent the inner flange, to permit thereby positioning of the inner flange against one upper edge of the groove and pivoting the moulding to lower the outer flange onto the other upper edge of the groove and place the base portion in the groove.

BRIEF DESCRIPTION OF THE DRAWINGS

Preferred embodiments of the invention are shown in the drawings wherein:

FIG. 7 is a top plan view of the door slab with router guide of FIG. 5 demonstrating a dual pass of the router to form the full with for the groove;

FIG. 8 is a perspective view of a corner of the door showing the cutting of a groove proximate the corner of the door; and FIG. 9 is a perspective view of the top surface of the door showing the entire groove cut in the door face in which the moulding is to be affixed.

DETAILED DESCRIPTION OF THE PREFERRED EMBODIMENT

Figure 1:
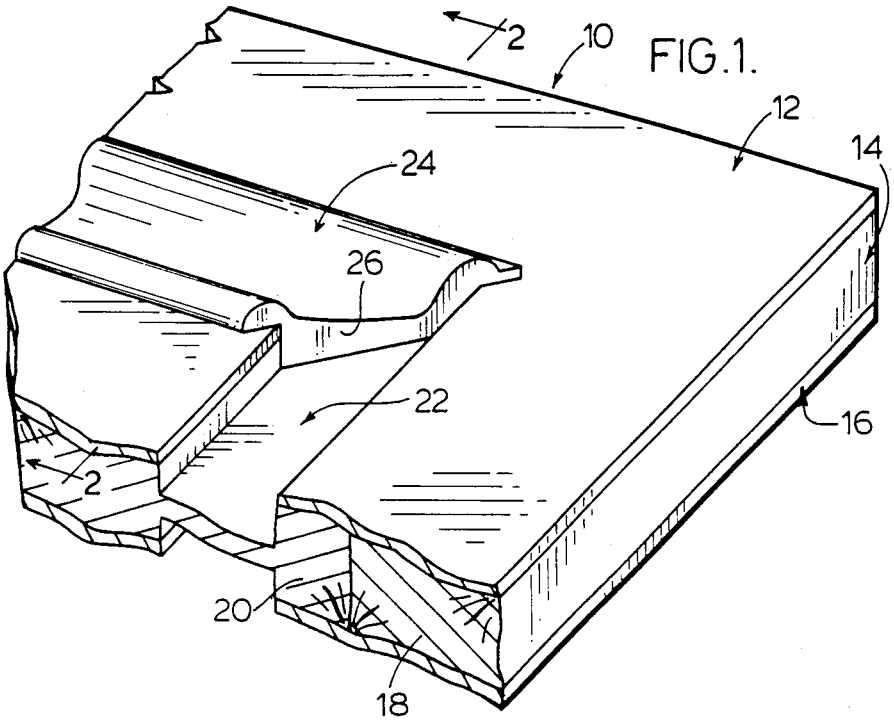
FIG. 1 is a perspective view of a corner portion of a door having the moulding applied thereto.

The moulding construction, according to this invention, can be used in any type of composite panel such as slab doors, wall board, cabinet doors, ceiling panels and the like. For purposes of demonstrating a preferred embodiment of this invention, the use of a moulding in a slab door is described. As shown in FIG. 1, a door 10 comprises a veneer 12 laminated to a core 14. Since the door has two exposed surfaces, the underside of the door has a second veneer 16 laminated to the core 14 where the veneer 16 may be the same as the veneer 12 as is commonly found in the marketplace. Such veneers may be formed of a variety of types of wood, such as pine, oak, mahogany, etc. Although such door surfaces when finished present a fairly pleasing appearance, they are, however, somewhat ordinary in the sense that the surface is all in one plane. It is, therefore, desired to modify the door face to include a moulding which enhances the overall appearance. According to this invention, the moulding used is recessed to give an impression of depth in the face of the door while at the same time permitting formation of a groove in the door without requiring elaborate machinery to avoid chipping of the very sensitive veneers 12 and 16.

The door 10 with the veneers laminated in place has a core 14 consisting of an outer solid wood casing 18 to match the wood of the veneers. Within the casing 18 is a solid particle board construction 20. A groove 22 is formed in the door core as it extends through the veneer 12 to receive a moulding 24. The groove is formed in a manner to be discussed with respect to FIGS. 4 through 9. The moulding 24 is placed into the groove 22 and affixed in the groove by use of glue, nails or other types of affixing devices. With the embodiment illustrated in FIG. 1, the moulding 24 has a miter at 26 to form a miter joint with corresponding moulding 24 extending down the other side of the door.

Figure 2:
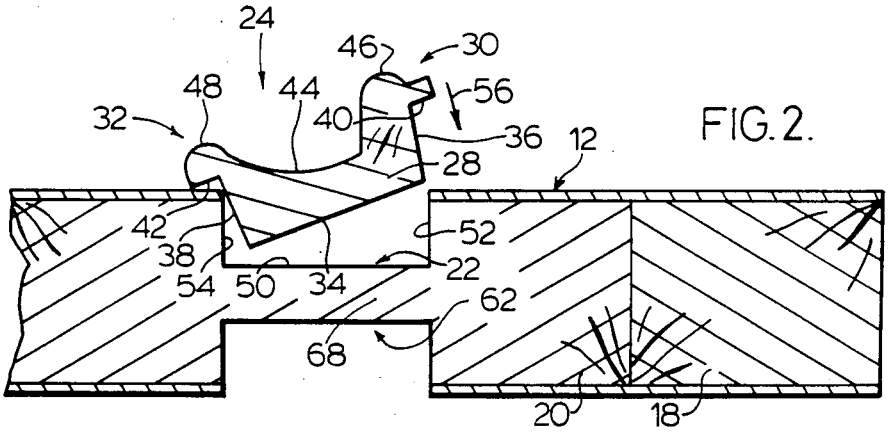
FIG. 2 is a section along the lines 2—2 of FIG. 1 showing the insertion of the moulding into the groove.

As shown in FIG. 2, the moulding 24 comprises a base portion 28 and two flange portions 30 and 32. The base portion 28 has a flat bottom 34 with upstanding side walls 36 and 38. The side walls 36 and 38 merge into the respective flanges 30 and 32. The flanges each have a planar underside 40 and 42.

To provide a decorative appearance for the exterior of the moulding 24, a recess 44 is formed in the base 28 of the moulding. The bottom of recess 44 is well below the flanges 30 and 32 in fact below the plane defined by the undersides 40 and 42 of the flanges which lie roughly in the same plane as the veneer 12. The recess 44 provides a depth dimension such that, when the door is viewed with the moulding in place, the moulding provides the appearance of a recessed panel portion in the door face. The flanges 30 and 32 include rounded upper portions 46 and 48 to enhance and provide a smooth transition from the edges of the moulding to within the recess 44.

Figure 3:
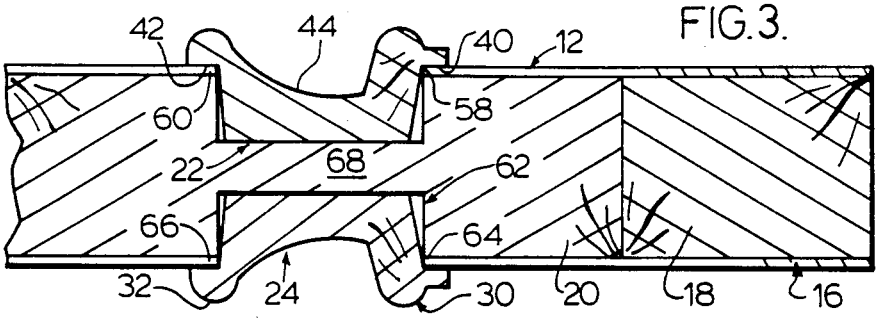
FIG. 3 is the section of FIG. 2 with both mouldings in place.

The groove 22 is formed to provide a generally U-shaped construction and according to this embodiment, is rectangular having a bottom 50 with side walls 52 and 54. The side walls 36 and 38 converge towards one another from the flanges 30, 32 towards the base bottom 34. Such sloping of the side walls 36 and 38 facilitates insertion of the moulding into the groove 22. According to the preferred embodiment shown, the side wall 36 is sloped inwardly more than the side wall 38. This permits positioning of the moulding flange 32 against one side of the groove and then pivoting the moulding in the direction of arrow 56 to provide for fitment of the moulding 24 in the groove 22. As shown in FIG. 3, the flange undersides 40 and 42 overlap the veneer 12 along the upper edge portions 58 and 60 of the groove 22. Therefore, when the groove 22 is formed by a milling operation, the edges 58 and 60 of the veneer 12 may become chipped or in some way damaged by the cutter. However, by using a moulding with flange portions 30 and 32 overlapping the edges of the veneer 12 along the groove 22, such chips in the veneer are not visible. Thus the flange portions not only serve to provide an appealing shape in relation to the recess portion 44, but also serve the important function of covering up any imperfections along the edges of the veneer 12.

According to this particular embodiment, the moulding may be provided on both faces of the door. Hence an additional groove 62 may be formed in the other face of the door, as it extends into the core 20 through the veneer 16. The same moulding 24 may be applied to this groove with the flange portions 30 and 32 overlapping the corresponding edges 64 and 66 of the veneer 16 along the groove 62. Preferably the bottom wall 34 of the moulding is glued to the bottom of each groove 22 and 62 to affix the moulding in place. Due to the sloping side walls 36 and 38, space is provided between the side walls and the sides of the grooves to accommodate surplus glue and avoid glue being squeezed out of the groove onto the face of the veneer during fitment of the moulding into the groove. This assures that the glue does not mar the veneer finish so that subsequent staining of the completed door is not hampered. It is appreciated that a variety of cores may be used for slab doors. The particle board 20 for the core is preferred, since it provides a solid bridge portion 68 between the two grooves 22 and 62. It has been discovered that the overall strength of the door is increased rather than decreased by having the opposing grooves 22 and 62 in the door slab. By securing hard wood mouldings, such as oak, in the grooves, the door is rigidified about the outline of the moulding which may be rectangular and thereby reduce tendency of the door to warp over time. It is appreciated, where permissible, that the door core may be constructed of paper honeycomb, paper board, or the like. Depending upon the type of core used, this will determine whether glue, nail fasteners or other fastening devices are used to secure the moulding in place in the formed groove or grooves in the door slab.

Figure 4:
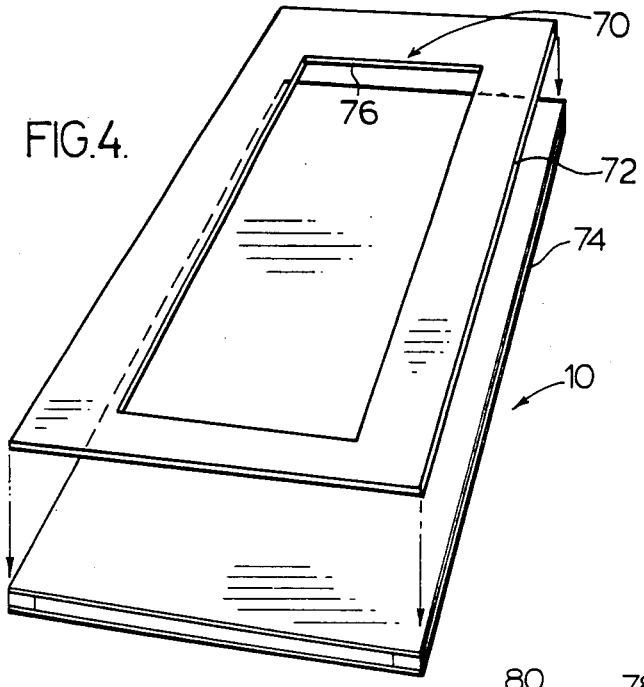
FIG. 4 is a perspective view of a door slab with a router guide to be secured to the slab.
Figure 5:
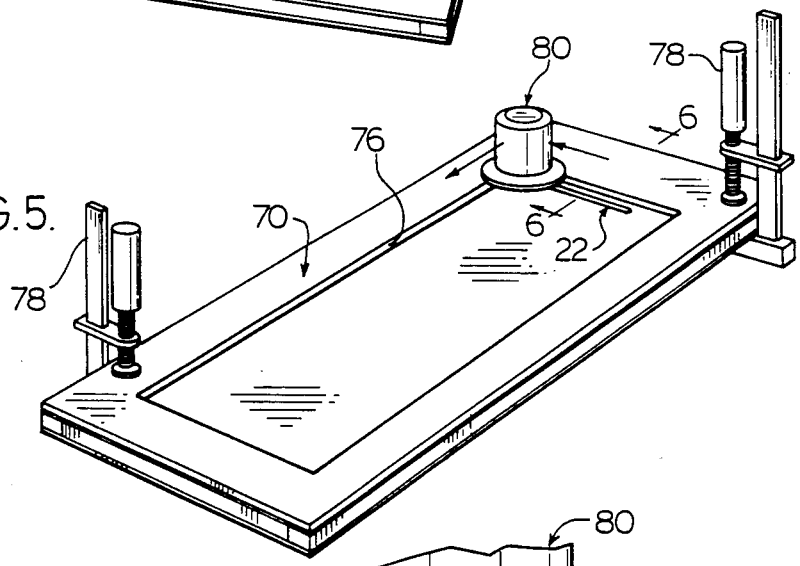
FIG. 5 is a perspective of a door slab with the router guide in place for guiding the router to cut the groove.

By using a moulding construction of the type discussed with respect to FIGS. 1 through 3, it will become apparent in FIGS. 4 through 9 how easy it is to form the grooves for receiving the moulding pieces. As shown in FIG. 4, the door 10 has lowered onto its face a template or router guide 70. The router guide has an outer edge 72 which is coincident with the outer edge 74 of the door about its periphery. The guide 70 includes an interior edge 76 which defines the outline of the groove to be formed in the door face.

The guide 70 is then clamped by clamps 78 in position as indicated by aligning the edges 72 of the guide with the edges 74 of the door. A router 80 is then used to commence formation of the groove 22. The router 80 is moved around the interior edge 76 of the guide 70 to form the rectangular shape for the groove 22 which determines the outline of the moulding to be placed in the door face.

Figure 6:
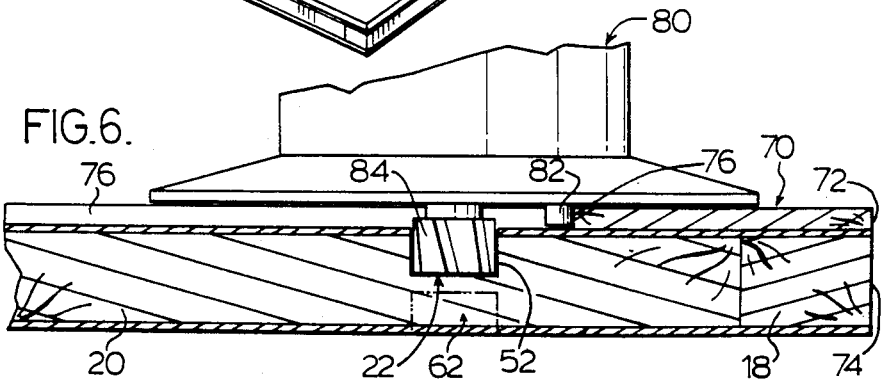
FIG. 6 is a section through the door slab showing the positioning of the router in cutting the groove.

As shown in the section along line 6—6 of FIG. 6, the guide 70 has the outer edge 72 flush with the outer edge 74 of the door. The router 80 may be of the standard type having a depending pin arrangement 82 for engaging the inner edge 76 of the guide to determine thereby the exact position of the cutter element 84 relative to the guide edge 76 for forming the first side 52 of the groove 22. By flipping the door over and securing the guide in place on the other side of the door, groove 62 may be formed as shown in dot.

When the core is of particle board, it is very difficult to form a wide groove by a single pass with the tool bit. As shown in FIG. 7, two passes of the router 80 are required to achieve the overall desired width for the groove 22. The guide 70, as fixed in place, defines the positioning for the first pass in forming portion 22*a* of the groove. To guide the second pass for the router 80, a supplemental guide strip 84 is retained against the edge 76 so as to space the router outwardly and in providing the second pass form the remaining portion 22*b* of the groove 22. Although not shown, the supplemental guide strip 84 may be in the shape of a rectangular frame which fits precisely within the boundary defined by the edge 76 to in essence provide a new interior guide face for the router 80 in making the second pass. In this manner, the groove may be formed without the need of a special router and an additional advantage in using a smaller diameter bit 86. The portion of material 88 left at the corner 90 of the groove, as shown in FIG. 8, is minimal. By use of a chisel or the like, the arcuate portion 88 may be removed to form the desired square corner 90 of the groove 22. When both passes with the router are complete, the guide is removed to provide the door 10, as shown in FIG. 9, with a completed groove 22. The groove is rectangular in outline and thereby defines the moulding border for the door slab. The moulding 24 is then fitted into the groove 22 with miter joints at the corners, thereby breaking up the planar surface of the veneer 12 to define an inner door panel portion 92 which, as surrounded by the moulding 24, gives the effect of a carved panel door while the grain of panel 92 matches the grain of the veneer 12 outside of the moulding border. This avoids the significant problem with prior types of panel doors constructed from components in that the grain of the individual components do not match up and hence component doors have a rather spotty appearance, particularly when stained.

The moulding construction, according to this invention, therefore provides in a simple, economical manner a technique for applying moulding to a slab of laminate material to create the effect of a solid hand carved decorative panel, while using relatively inexpensive slab materials with thin fragile veneers.

Although preferred embodiments of the invention have been described herein in detail, it will be understood by those skilled in the art that variations may be made thereto without departing from the spirit of the invention or the scope of the appended claims.

THE EMBODIMENTS OF THE INVENTION IN WHICH AN EXCLUSIVE PROPERTY OR PRIVILEGE IS CLAIMED ARE DEFINED AS FOLLOWS:

1. A slab door of standard dimensions comprising a composite having a front surface of veneer laminated to a solid core, a moulding recessed in said composite slab to define a decorative panel design, a groove being provided in said slab of an outline which defines said moulding border, said groove being generally rectangular in cross-section as formed in said core and extending through said veneer, said groove having wall portions which define said rectangular shaped groove with said wall portions terminating at said veneer to define upper parallel edges of said groove, said moulding having a base portion for fitment into said groove and a flange portion extending along each side of said base portion for overlapping and covering said veneer along said groove upper edges, said moulding having a recess formed into said base below said flange portions and below a plane defined by said veneer, said moulding base has an essentially planar lower surface with first and second upright sides merging into respective said flange portions, said upright sides sloping inwardly from said respective flange and coverging towards said base lower surface, said moulding having an inner flange and an outer flange, said first upright side of said moulding base adjacent said inner flange sloping inwardly more than said second upright side adjacent said inner flange to permit thereby positioning of said inner flange sloping inwardly more than said second upright side adjacent said inner flange to permit thereby positioning of said inner flange against one upper edge of said groove and pivoting said moulding to lower said outer flange onto the other upper edge of said groove and place said base portion in said groove, and glue as applied o said moulding base lower surface and said first and second upright sides, affixing said moulding base to said groove wall portions.

* * * * *